United States Patent [19]

Jäeger

[11] 3,995,100

[45] Nov. 30, 1976

[54] ARRANGEMENT FOR THE PRODUCTION OF INGOTS FROM HIGH-MELTING METALS, PARTICULARLY STEEL, BY ELECTROSLAG REMELTING

[75] Inventor: Heimo Jäeger, Bruck (Mur), Austria

[73] Assignee: Gebr. Bohler & Co. AG, Vienna, Austria

[22] Filed: May 27, 1975

[21] Appl. No.: 580,702

[30] Foreign Application Priority Data

May 28, 1974 Austria ..... 4375/74

[52] U.S. Cl. ..... 13/9 ES; 13/9 R

[51] Int. Cl.[2] ..... H05B 3/60; H05B 11/00

[58] Field of Search ..... 13/9, 9 ES, 9 P

[56] References Cited

UNITED STATES PATENTS

| | | | |
|---|---|---|---|
| 3,136,835 | 6/1964 | Dillon et al. | 13/9 |
| 3,652,773 | 3/1972 | Holzgruber et al. | 13/9 |
| 3,723,630 | 3/1973 | Paton et al. | 13/9 X |
| 3,749,803 | 7/1973 | Camacho | 13/9 |
| 3,767,831 | 10/1973 | Plockinger et al. | 13/9 X |

*Primary Examiner*—R. N. Envall, Jr.
*Attorney, Agent, or Firm*—Toren, McGeady and Stanger

[57] ABSTRACT

An arrangement for the production of ingots from high-melting metals, such as steel, by electroslag-remelting is disclosed. A water-cooled ingot mold including a bottom plate forms the solidifying ingot, the ingot being a solidifying portion and a liquid sump. A self-consuming electrode extends into a layer of molten slag covering the liquid sump. An a.c. source is connected between the plate and self-consuming electrode. The mold is adapted to be raised in a known manner. At least one tubular auxiliary electrode is provided with a plasma-forming gas. A d.c. source is connected to the auxiliary electrode and the bottom plate of the mold, the d.c. source being independent of the a.c. source. Various forms of the auxiliary electrode are described.

17 Claims, 4 Drawing Figures

ARRANGEMENT FOR THE PRODUCTION OF INGOTS FROM HIGH-MELTING METALS, PARTICULARLY STEEL, BY ELECTROSLAG REMELTING

BACKGROUND OF THE INVENTION

The present invention relates to an electroslag remelting or refining process for the removal of impurities from a metal, particularly steel.

An arrangement is known which permits the utilization of the advantages of fusion-electrolysis, hence the discharge of undesired ions, in electroslag remelting by means of at least one self-consuming electrode. Such an arrangement is described in U.S. Pat. No. 3,571,475 to Holzgruber, et al, issued Mar 16, 1971. This arrangement permits the control of the direction of metallurgical reactions and the removal of undesired elements, like sulfur, oxygen etc., to an increasing extent from the melt. It makes use of the principle that the slag, which is present in the molten state in the remelting system, is to a great extent ionized due to the joulean heat generated during the passage of the current, and the individual ions can be moved in the slag by superposing a direct current.

In electroslag-remelting or refining with alternating current, the polarity of self-consuming electrode and liquid ingot sump changes periodically according to the supply frequency. When the electrode passes through the positive half wave, for example, the ingot sump forms the negative pole. By means of at least one non-melting auxiliary electrode, which consists preferably of graphite, a d.c. component is introduced by way of rectifiers into the remelting system so that both the electrode and the ingot have a positive (or negative) potential difference relative to the auxiliary electrode. In this manner, it is possible to start a fusion electrolysis which results, on the one hand, in an ionic migration to the auxiliary electrode, and on the other hand, in migration to the self-consuming electrode and to the sump. Depending on the polarity of the auxiliary electrode, certain ions are discharged on the auxiliary electrode and deposited after reactions with the electrode graphite or atmospheric oxygen. Chemical reactions with the slag are also possible.

Such a known electroslag remelting system is connected to an a.c. transformer having one pole connected to the melting electrode and having a second pole connected to the bottom plate, and thus to the ingot. This single-phase transformer supplies the a.c. energy required for the electroslag-remelting. The current direction between ingot and consuming electrode changes with the a.c. frequency. By introducing non-melting auxiliary electrodes into the slag, it is possible to superpose a d.c. component on this a.c. flux, the direct current flowing to or from the auxiliary electrode system. A second pole then supplies the melting-electrode or the ingot. The d.c. voltage is generated by a rectifier. In order to pole the self-consuming or melting electrode to the auxiliary electrode, the ingot phase is connected with the auxiliary electrode system by way of a rectifier so that the positive or the negative half wave becomes effective, depending on the direction of the current through the rectifier. According to the same system, the melting electrode phase is connected with the auxiliary electrodes. A switch is provided which is able to reverse the polarity of the auxiliary electrodes. A rheostat can be connected to regulate the auxiliary electrode current. The regulation of the current can be effected, on the one hand, by the resistance and, on the other hand, by the position of the auxiliary electrode system in the slag relative to the ingot and consuming electrode.

A substantial part of the known arrangement consists thus of one (or several) non-melting auxiliary electrodes dipping into the slag, which electrodes consist preferably of graphite. In practical operation, the service life of these non-melting auxiliary electrodes is of great importance, since melting times of 100 hours or more must be expended for the production of large ingots, and chemical reactions between the auxiliary electrode and the slag must be avoided. Particularly, the carbonization of the remolten ingots by the graphite of the auxiliary electrodes in the above described system is a serious disadvantage.

Another disadvantage of the known arrangement is that the direct current for feeding the auxiliary electrodes is taken from the a.c. circuit and supplied by way of rectifiers to the auxiliary electrode system. Since one half wave of the alternating current is rectified, non symmetries occur in the transformer in the primary side. In addition, the desired electrolytic reactions only take place above a certain threshold voltage. The superposed voltage must therefore be regulatable to a great extent. In the case of the known arrangement, the voltage can only be varied, however, by varying a rheostat.

SUMMARY OF THE INVENTION

It is an object of the present invention to provide auxiliary electrodes in an electroslag remelting system wherein the useful life of such electrodes is considerably extended.

It is another object of the present invention to provide auxiliary electrodes in an electroslag remelting system wherein such electrodes reduce or eliminate undesired chemical reactions with said electrodes.

It is a further object of the present invention to provide auxiliary electrodes in an electroslag remelting system wherein such electrodes improve the purity of the resulting metal ingot.

It is still another object of the present invention to provide a system for electroslag remelting wherein separate and independent d.c. and a.c. circuits are provided so as to allow completely independent adjustment of the two sources.

It is still a further object of the present invention for providing an electroslag remelting system wherein the total energy consumption is reduced. In accordance with the present invention, in an arrangement for the production of ingots from high-melting metals, particularly steel, having at least one self-consuming electrode and an a.c. source, the a.c. source is connected between the bottom plate of a water-cooled mold and the self-consuming electrode. The mold contains a solidfying portion of the ingot and a liquid sump and is adapted to be raised. The liquid sump is covered by a layer of molten slag and the self-consuming electrode dips into the slag. At least one tubular auxiliary electrode is included which is coupled to a feed pipe for supplying a plasma-forming gas. The auxiliary electrode is electrically coupled with the bottom plate by means of a d.c. source which is independent of the a.c. source.

For a better understanding of the present invention, reference is made to the following description and accompanying drawings, while the scope of the invention is pointed out in the appended claims.

DETAILED DESCRIPTION OF THE INVENTION

Figure 1:
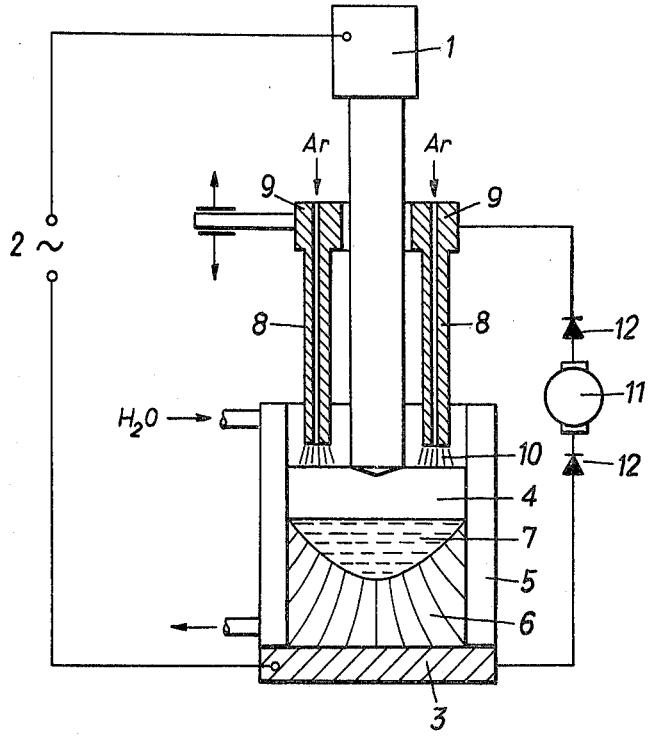
FIG. 1 is a partially schematic and partially cross-sectional drawing of an electroslag remelting system in accordance with the present invention.

An electroslag remelting or refining arrangement according to the invention permits the d.c. energy to be transmitted in the form of plasma into the slag. To this end, the auxiliary electrode is made tubular, and a plasma-forming gas, preferably argon, is passed through, so that a plasma arc is produced between the auxiliary electrode and the slag. This embodiment of the auxiliary electrodes leads to a reduction of the graphite consumption and further improves the deposit of gaseous deoxidation products. The surface of the graphite electrodes is preferably protective against erosive slag vapors by coating it with a high-alumina mortar. The mortar consisted substantially of about 90% alumina-silicate and water glass as a binder. The coating prevents the formation of graphite soot with the resulting carbonization of the melt.

The d.c. plasma flame, which prevents direct contact between the auxiliary electrode and the slag, permits, just like a dipping electrode, electrolytic reactions between the ionized slag and the liquid metal film at the tip of the melting electrode, the atmosphere, and the auxiliary electrode. The arc length is 1–5 cm, depending on the superposed voltage. The greater distance between the auxiliary electrode and the slag, and also the reduction of the oxygen-partial pressure above the slag by argon and the cooling effect of the rare gases in the bored auxiliary electrode, help reduce its oxidation. Since the partial pressure of all other gases above the slag is similarly reduced by the rare gas, their deposit is facilitated and enhanced during the remelting. This applies, for example, to $SO_2$, $S_3$ , gaseous $O_2$, $H_2O$ vapor, HF, and CO or $CO_2$. Thus, it is possible for the first time by the application of plasma superposition to reduce the hydrogen content of the remelted electroslag ingot decisively compared to that of the melting electrode, even with the low $H_2$-contents of the electrode.

Furthermore, the plasma flame is used for additional heating of the slag. This has, for example, the advantage of a more uniform temperature distribution in the slag both with a flatter sump, which results in better solidification conditions. The total energy consumption for the remelting is reduced. Since metallic aluminum is present by the electrolytis reaction in finely divided form at the phase boundary electrolytic non-metallic line alumina occlusions are similarly formed in a very fine distribution.

If argon is used as a plasma-forming gas, a certain protective gas effect appears as an additional effect, which is of importance in the remelting of steels with high oxygen-affinity elements (Ti, Al Zr, CeLa etc.).

The d-c source, which can be a welding generator, for example, is arranged independent of the a.c. circuit.

Accordingly, both the superposed current intensity and the d.c. voltage can be varied within wide limits. For separating the a.c. and d.c. circuit, rectifiers are preferably arranged as filter sections in front of both poles of the d.c. generator.

FIG. 1 shows an electroslag remelting or refining arrangement according to one embodiment of the present invention. Shown are the melting electrode 1, which is connected by way of an a.c. source 2 to the bottom plate 3, the slag layer 4, and the raisable water-cooled ingot mold 5 in which the solidified ingot 6 with the liquid ingot sump 7 is formed. Since this principal design of an electroslag remelting system is sufficiently known from the literature, FIG. 1 is presented in only as a schematic representation. In accordance with the present invention, at least one auxiliary electrode 8, which has a tubular form is connected to feed pipes 9 for plasma-forming gas, referably argon, and is put in electrical contact with the bottom plate 3 by way of a d.c. source 11, which is independent of the a.c. source 2. In the operation of this system, the plasma arcs 10 operate as electrically conductive connections between the auxiliary electrodes and the slag. Rectifiers 12 can be arranged as filter sections in front of both poles of the d.c. source 11. The d.c. energy is preferably 10–30% of the a.c. energy and the current density at the auxiliary electrodes is preferably 1–6 A/cm$^2$.

Figure 2:
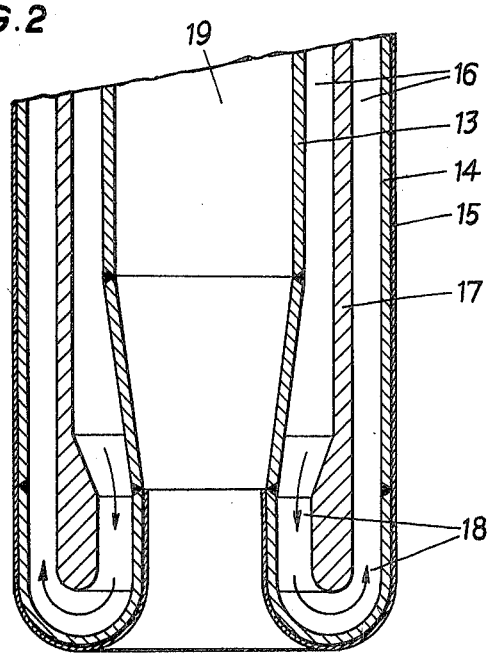
FIG. 2 is a cross-sectional view of a tubular auxiliary electrode for use in the system of FIG. 1.

The superposed current intensity is kept constant by the thyristor-controlled regulation of the rectifiers with the d.c. voltage depending on the length of the arc. By direct current for the purposes of the invention, intermittent or pulsating direct current is also contemplated. FIG. 2 shows another construction of the non-melting electrodes 8. An inner copper tube 13 and an outer copper tube 14 are preferably provided with iridium coating 15. Cooling is effected by a cooling water pipe 17 provided with water channels 16. The arrows 18 indicate the direction of flow of the cooling water. The supply of plasma-forming gas is provided through the duct portion 19.

The subject of the present invention is therefore an arrangement for the production of ingots from high-melting metals, particularly steel, by electroslag-remelting, consisting of at least one melting electrode 1, which is connected by way of at least one a.c. source 2 with the bottom plate 3 of a water-cooled ingot mold 5, which can be raised in known manner, and which dips into the molten slag 4, the solidified ingot 6 with the liquid ingot sump 7 being formed in the mold 5. The invention consists further in that at least one tubular auxiliary electrode 8 is connected to at least one feed pipe 9 for plasma-forming gas, preferably argon, and is in electrical contact with the bottom plate 3 by way of a d.c. source 11, which is independent of the a.c. source 2.

In order to separate undesired minute steel impurities from the slag and the liquid metal dripping through it, the auxiliary electrode is kept at a polarity which is opposite to the polarity of the metal impurities to be separated, which are present in the ionized state.

If the passage of undesired metal impurities into the slag is to be avoided, the auxiliary electrode is kept at a polarity which is equal to the polarity of the desired impurities, which are present in the ionized state.

Figure 3:
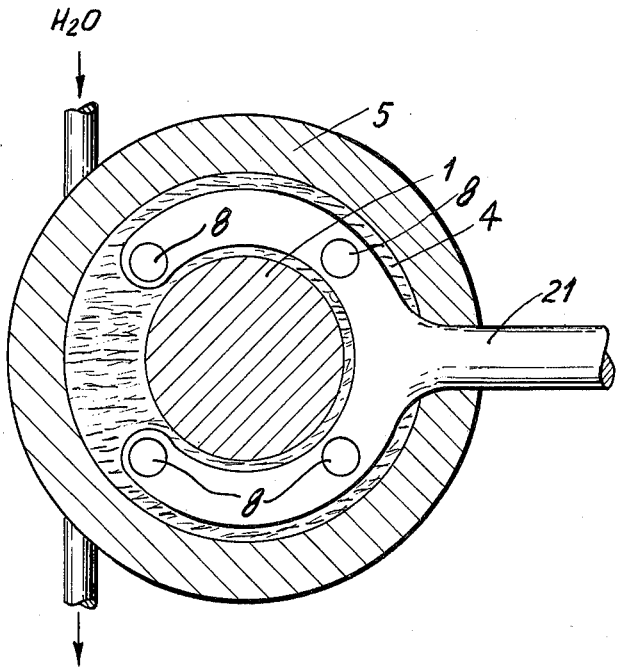
FIG. 3 is a cross-sectional top view showing a cylindrical arrangement of auxiliary electrodes.
Figure 4:
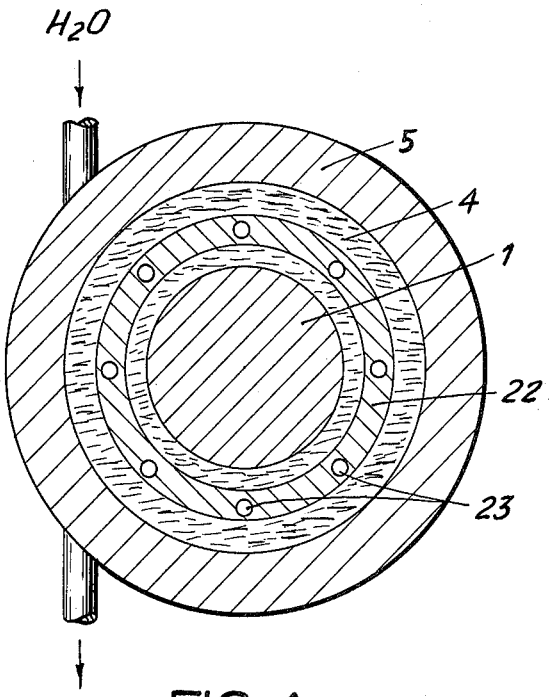
FIG. 4 is a cross-sectional top view showing a cylinder shaped auxiliary electrode.

The invention can be modified in various ways. Thus, the fusion-electrolysis can be carried out by means of several tubular, evenly spaced auxiliary electrodes whose axes extend on an imagined cylindrical surface concentrically surrounding the self-consuming electrode. This arrangement is shown in FIG. 3. In this figure, elements corresponding to those in FIG. 1 bear like numerals. Element 21 is a holder for the auxiliary electrodes 4. The tubular auxiliary electrode can also concentrically surround the melting electrode, where the outer tube is provided in turn with bores in the axial direction for the supply of the plasma-forming gas. An arrangememt of this type is shown in FIG. 4. Again elements corresponding to those in FIG. 1 bear like numerals. Element 22 is a cylinder-shaped auxiliary electrode which concentrically surrounds the consumable electrode 1. Bores 23 are provided for the supply of the plasma-forming gas.

In all cases, the plasma arc formed between the auxiliary electrodes and the slag cover provides the advantages described above, which consist primarily in an improved cleaning and heating effect. The device according to the application permits the method of electroslag-remelting to be more effective and provides metals of higher purity then prior known approaches.

While the foregoing specification and drawings represent the preferred embodiments of the present invention, it will be obvious to those skilled in the art that various changes and modifications may be made therein without departing from the true spirit and scope of the present invention.

What is claimed is:

1. In an electroslag-remelting arrangement for the production of ingots from high-melting metals, particularly steel, having at least one self-consuming electrode and an a.c. source, the a.c. source being connected between the bottom plate of a water-cooled ingot mold and the self-consuming electrode, an ingot being formed in said mold, which is adapted to being raised, said ingot having a solidifying portion and a liquid sump portion, said liquid ingot sump being covered by a layer of molten slag and wherein said self-consuming electrode extends into said slag, the improvement comprising that at least one tubular auxiliary electrode is included which is coupled to a feed pipe for supplying a plasma-forming gas, and a d.c. souce being connected between said auxiliary electrode and said bottom plate of the said mold, said d.c. source being independent of said a.c. source, said auxiliary electrode maintaining a predetermined distance from the slag layer at all times.

2. The arrangement of claim 1 wherein the plasma-forming gas is argon.

3. The arrangement of claim 1, wherein, in order to separate undesired minute steel impurities from the slag and from the liquid metal dripping through it, the auxiliary electrode is maintained at a polarity which is opposite to the polarity of the metal impurities to be deposited which are present in an ionized state.

4. The arrangement of claim 1, wherein, in order to avoid the passage of undesired steel impurities into the slag, the auxiliary electrode is maintained at a polarity which is the same as the polarity of the desired steel impurities which are present in the ionized state.

5. The arrangement of claim 1, wherein the tubular auxiliary electrode consists of graphite.

6. The arrangement of claim 5, wherein the surface of the graphite electrode is covered with a high-melting mortar of about 90% alumina silicate and waterglass as a binder.

7. The arrangement of claim 1 wherein the tubular auxiliary electrode consists of an inner copper tube and of an outer copper tube which are provided with an iridium coating, and further includes water channels, a cooling water pipe and a duct for the supply of plasma-forming gas.

8. The arrangement of claim 1, wherein several equally poled auxiliary electrodes are provided having axes extending on an imagined cylindrical surface concentrically surrounding the self-consuming electrode.

9. The arrangement of claim 1, wherein the tubular auxiliary electrode surrounds the melting electrode concentrically, the outer tube being provided in turn with bores in an axial direction for the supply of plasma-forming gas.

10. The arrangement according to claim 1, wherein rectifiers are arranged in series with both poles of the d.c. source for use as filter sections.

11. In a method for the production of cast blocks from high-melting metals, particularly steel, by electroslag remelting, including the steps of:

supplying an a.c. current from an a.c. source to at least one self-consuming electrode; said self-consuming electrode extending into a slag cover.

supplying a d.c. current from a d.c. source to at least one tube-shaped auxiliary electrode, said d.c. source being independent of said a.c. source;

suppyling a plasma-forming gas through said auxiliary electrode to conduct d.c. current to said slag cover and maintaining a predetermined distance between said slag cover and the auxiliary electrode.

12. An arrangement for the production of cast blocks from high-melting metals, particularly steel, by electroslag remelting comprising:

a consumable electrode consisting essentially of the metal to be remelted;

a liquid-cooled mold containing a solidifying portion, a liquid sump portion and a slag cover, said consumable electrode extending into the slag;

an a.c. source coupled to said consumable electrode;

a non-consumable auxiliary electrode having a plasma-forming gas supplied thereto extending from above into said mold but disposed at a predetermined distance from the slag; and a d.c. source coupled to said auxiliary electrode, said d.c. source being independent of said a.c. source and causing d.c. current to flow to the slag by means of the plasma-forming gas.

13. An arrangement as in claim 12 wherein the auxiliary electrode is provided with at least one downwardly extending channel for the supply of plasma-forming gas, said plasma-forming gas being argon.

14. An arrangement according to claim 12 wherein the auxiliary electrode is formed from at least one pipe portion through which the plasma forming gas flows, the pipe portion consisting essentially of graphite.

15. An arrangement according to claim 14, wherein the surface of the pipe portion consisting essentially of graphite is coated with a mortar containing a high value of kaolin of about 90% alumina silicate and water glass as binder.

16. An arrangement as claimed in claim 14, wherein each pipe portion comprises an inner copper tube through which flows the plasma-forming gas and a concentric outer copper tube, the outer tube being provided with an iridium coating and a cooling water guiding tube being concentrically arranged between the two tubes, the tubes forming the boundary of a cooling water channel which first leads from the top of the electrode downwardly and then from downward upwardly.

17. An arrangement in claim 14 comprising an auxiliary electrode which surrounds an electrode which consists of the metal to be remelted, this auxiliary electrode having essentially the form of a hollow cylinder, wherein the auxiliary electrode is provided with several channels which extend in the axial direction of the auxiliary electrode for the supply of the plasma forming gas.

* * * * *